US006513952B1

(12) United States Patent
Johnson et al.

(10) Patent No.: US 6,513,952 B1
(45) Date of Patent: Feb. 4, 2003

(54) SOCKET MOUNTING THAT ALLOWS LAMP TO REMAIN VERTICAL AS FIXTURE IS TILTED

(75) Inventors: David M. Johnson, Simpsonville, SC (US); Byron R. Collins, Tuxedo, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,000

(22) Filed: Nov. 6, 2001

(51) Int. Cl.[7] ..... F21V 17/02
(52) U.S. Cl. ..... 362/282; 362/322; 362/429
(58) Field of Search ..... 362/197, 199, 362/277, 280, 282, 319, 322, 333, 514, 515, 371, 388, 413, 429, 427, 220, 284, 532, 287, 324

(56) References Cited

U.S. PATENT DOCUMENTS 149,712 A * 4/1874 Boesch ..... 362/324
1,350,682 A * 8/1920 Stobs et al. ..... 362/532
3,543,016 A * 11/1970 Jones ..... 362/371
4,164,784 A * 8/1979 Jaksich ..... 362/282
4,410,933 A * 10/1983 Blake et al. ..... 362/371
4,489,368 A * 12/1984 Sangiamo et al. ..... 362/427
4,527,224 A * 7/1985 Sangiamo et al. ..... 362/282
4,569,329 A * 2/1986 Cherryholmes ..... 362/277
4,654,764 A * 3/1987 Hsiao ..... 362/199
6,039,466 A * 3/2000 Duchenne et al. ..... 362/284
6,354,722 B1 * 3/2002 Montenegro et al. ..... 362/514

* cited by examiner

*Primary Examiner*—Alan Cariaso
(74) *Attorney, Agent, or Firm*—Fay, Sharpe, Fagan, Minnich & McKee, LLP

(57) ABSTRACT

A high lumen output illumination device includes a light source secured within a socket and a reflector. The reflector redirects light emanating from the source along a direction of interest. The socket is mobile relative to the reflector and varies the directional output of the device. The socket holds the light source substantially vertical regardless of the relative angle of the reflector. The reflector includes a channel through which the socket moves. The device may also be inverted, keeping the light source substantially vertical, to give a range of illumination complementary to the range offered by tilting the reflector.

15 Claims, 4 Drawing Sheets

SOCKET MOUNTING THAT ALLOWS LAMP TO REMAIN VERTICAL AS FIXTURE IS TILTED

BACKGROUND OF INVENTION

The present invention relates to the artificial illumination arts. It finds particular application in high lumen output floodlights that utilize pulse arc metal halide tubes and will be described with particular reference thereto. It is to be appreciated, however, that the present invention is not limited to the aforementioned application.

In extremely high lumen applications, standard incandescent bulbs are not adequate, even with state of the art directional reflectors. Typically, in many high powered floodlights, an arc tube instead of an incandescent filament is used. The arc tube, rather than having a filament as standard incandescent bulbs do, has a tube with an electrode at each end. When enough of a potential difference is present: between the two electrodes, charge carriers arc, that is, jump between the two electrodes, exciting electrons in the gas contained within the tube. The excited electrons decay back to their original energy levels, emitting photons, which are perceived as visible light from the arc.

Typically, such arc tubes are mounted into a fixture that includes some manner of reflector, so that the light emanating from the arc tube can be focused or directed in a general direction. The tube is set in a fixed position relative to the reflector, then the whole tube/reflector assembly is tilted, oriented or aimed at a region where illumination is desired.

While this works for many arc tubes, some extremely high power arc tubes must remain in a substantially vertical position. This restriction severely limits the directional range of standard reflector systems, as the fixtures cannot be tilted to any great degree.

Some types of current fixtures allow movement of the lamp relative to a reflector, such as Nielson, (U.S. Pat. No. 5,111,371) and Douglas (U.S. Pat. No. 5,722,770). These systems disclose fixed reflector orientations, and move the lamp to achieve optimal operating characteristics. In these configurations, however, the orientation of the lamp does not change relative to the reflector (assuming a symmetrical lamp).

SUMMARY OF INVENTION

In accordance with one aspect of the present invention, a directional illuminating device is provided. A socket for receiving a light source is secured to a base. A reflector is movably connected to the base that re-directs and re-focuses light by virtue of movement of the reflector. The reflector includes a channel through which the socket is fixedly connected to the base.

In accordance with another aspect of the present invention, a directional illuminating device is provided. A reflector is movably connected to a socket, the socket being for receiving a light source. The socket is fixedly connected to a base assembly, the base assembly holding the socket and light source in a substantially vertical position. A guide track in the reflector movably secures the reflector to the socket, the track providing a range of arc about the light source.

According to another aspect of the present invention, a directional illuminating device is provided. A socket for receiving a light source is fixedly mounted to a base. A reflector having an inner reflective surface is movably connected to the base. A channel in the reflector provides the reflector with a range of motion about the light source. Securements provide movable attachment between the reflector and base, and can be tightened to provide fixed attachment between the reflector and base.

BRIEF DESCRIPTION OF DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION

Figure 1:
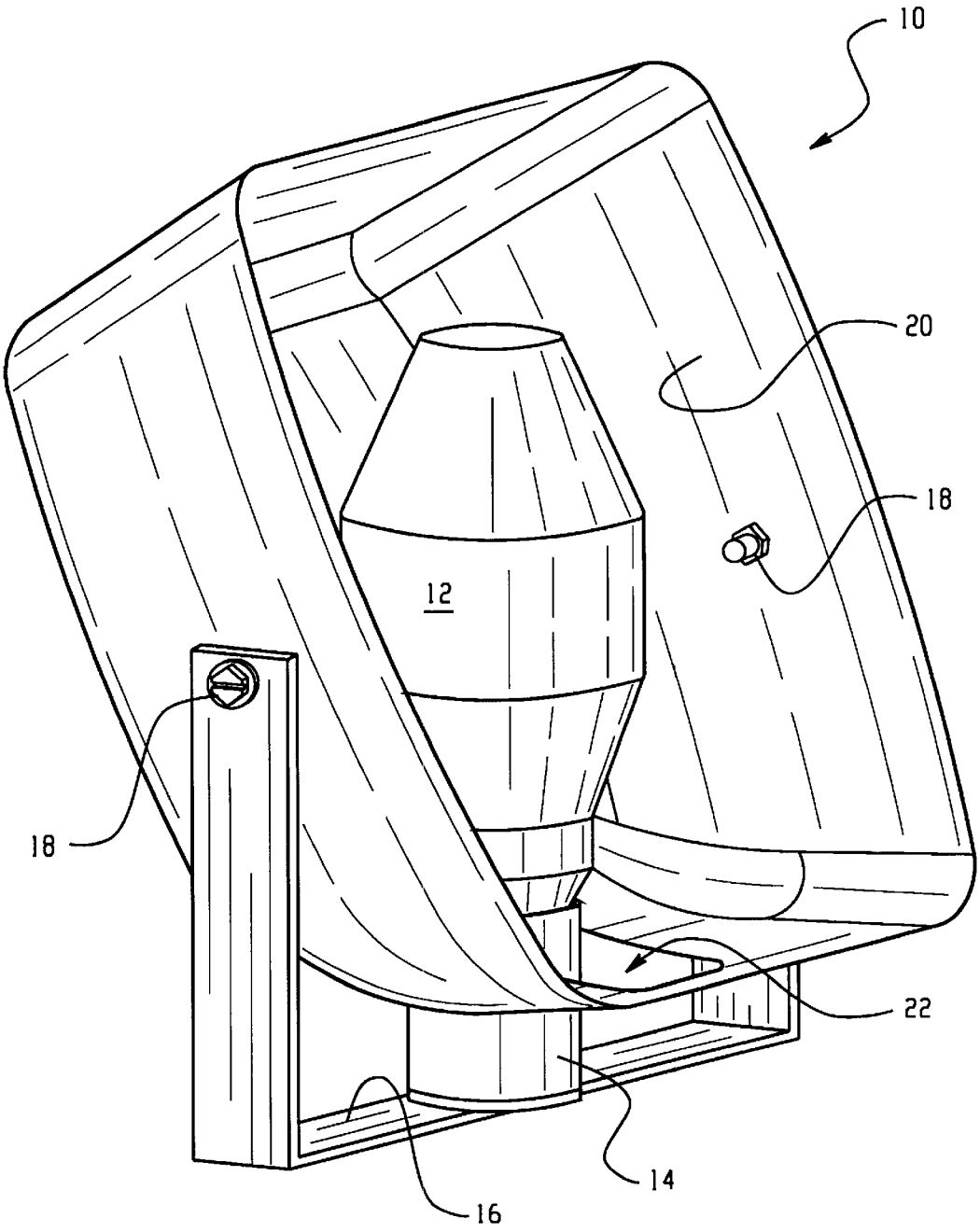
FIG. 1 is a perspective view of a first preferred embodiment of an illuminating device, in accordance with the present invention.

With reference to FIG. 1, in a first embodiment of an illuminating device 10, a light source 12 is secured within a socket 14. Preferably, the light source 12 is a metal halide lamp such as but not limited to a PulseArc™ metal halide lamp made by General Electric. The socket 14 is secured to a base 16. The base 16 includes a U-shaped member at the extremities of which are securements or fasteners 18, such as screws or knobs, which secure the base 16 to a reflector 20. In the preferred embodiment, the reflector 20 is a directional reflector, with the center of the light source 12 being preferably located at its focal point, approximately at the same height as the securements or fasteners 18 with respect to the bottom of the U-shaped member.

The fasteners 18 loosely secure the base 16 to the reflector 20. The reflector 20 is able to pivot about the two fasteners 18 by virtue of a channel 22 in the reflector 20. The channel 22 preferably allows the reflector 20 to tilt a range of 45° with reference to the socket 14, which is fixed on the base 16. Greater or lesser degrees of freedom that the channel 22 allows have also been contemplated. The preferred light source 12 typically has a 15° tolerance with respect to the vertical, giving the range of the illuminating device 10 a range of approximately a 60° arc.

It is to be understood that the device 10 may be inverted to achieve an additional 60° range. In this inverted configuration, the light source 12 remains vertical, with its electrodes reversed from the original configuration. Pictorially, the above referenced inversion would be achieved if FIG. 1 were rotated 180° from its original orientation.

In an illustrative example, the device 10 is used in a parking lot flood light application. In this application, the reflector 20 is directed downward so that the light illuminates a region around the base of a lamppost. In a separate application where illumination is desired above the device 10, such as lighting a flagpole at night, the device 10 is inverted with respect to the lamppost application. Inverting the device 10 gives a complementary range of illumination to the non-inverted configuration.

Upon selection of the desired position of the reflector 20 the fasteners 18 are tightened to secure the position of the reflector 20 relative to the base 16. In this manner, the illuminating device 10 is oriented for a single, present, application, but can be re-oriented at a later time for further applications. In an alternate embodiment, the fasteners are not securely tightened and extra weight is added to the underside of the base. In this embodiment, gravity keeps the light source vertical.

Figure 2:
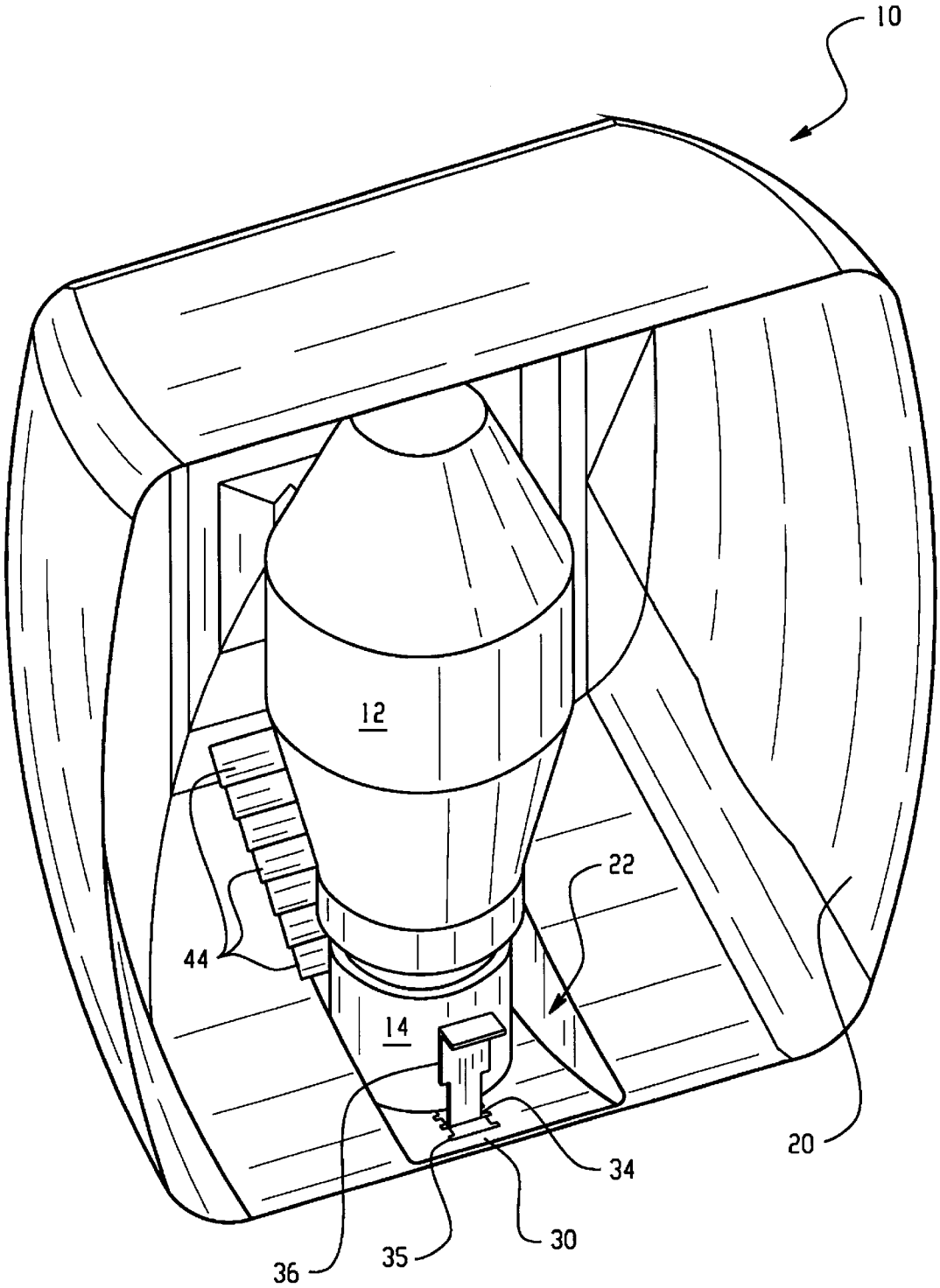
FIG. 2 is a perspective view of a second preferred embodiment of the illuminating device.
Figure 3:
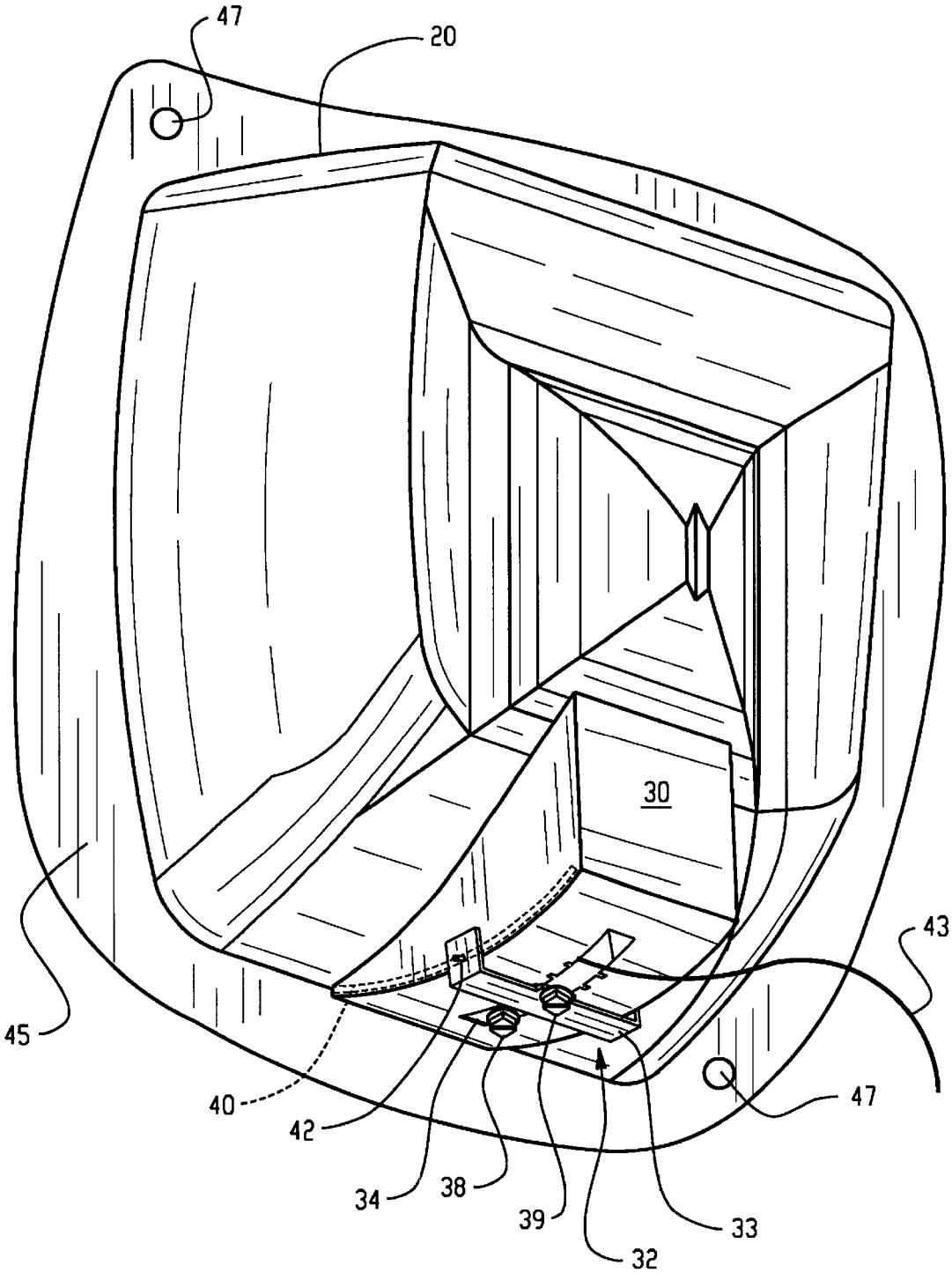
FIG. 3 is a perspective view of the reverse side of the second preferred embodiment of the illuminating device.
Figure 4:
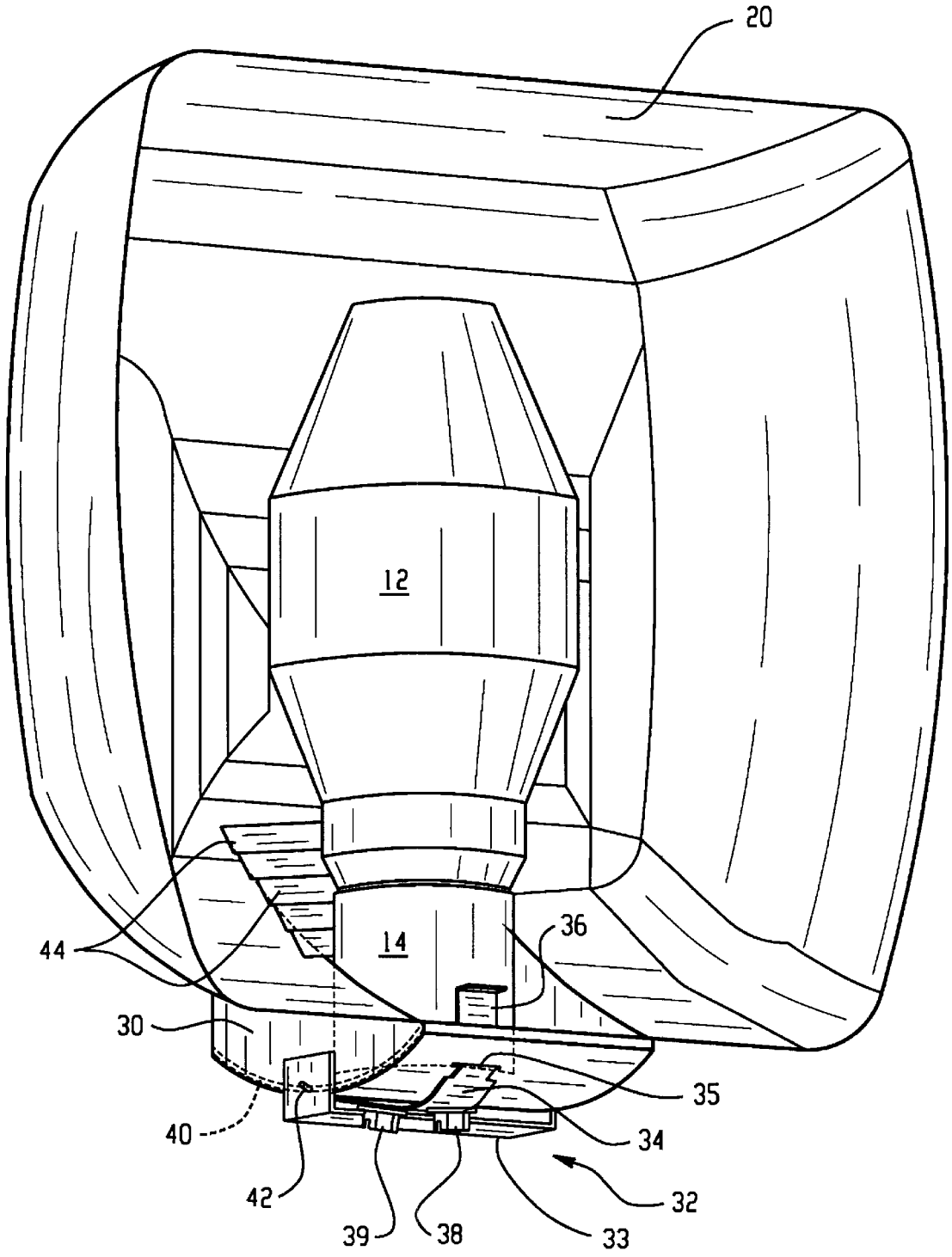
FIG. 4 is a perspective view of the underside of the second preferred embodiment of the illuminating device.

In another embodiment, and with reference to FIGS. 2, 3, and 4, the light source 12 is carried in the socket 14, which is adjacent to the reflector 20. In this embodiment, the reflector 20 is attached so as to be slidable relative to the socket 14. The reflector 20 includes a track 30 which permits controlled movement of the reflector 20 about socket 14.

The socket is positioned along the track 30 and secured by tightening a base 32, which holds the socket 14 into position relative to the reflector 20. In one embodiment base 32 includes two perpendicular pieces, a first u-clamped bar 33 and a second bar 34. Optionally, as seen FIGS. 2 and 3, the track 30 includes discrete notches 35 into which a clip 36, carried on bar 34, is inserted to secure the reflector 20 relative to the socket.

At least one bolt 38 extends from the underside of the base 32, through the base 32, through the track 30 and into the socket 14 securing the socket 14 in an immobile relationship to the base 32. Preferably, as is illustrated in FIG. 3, two bolts 38, 39 are used to prevent rotation of the socket 14 relative to the base 32. When the clip 36 is depressed, or when the bolts 38, 39 are loosened, there is nothing that obstructs movement of the track relative to the base 32 and socket 14. Thus the reflector 20 is free to tilt relative to the light source 12 along the track. Particularly, as track 30 moves, a portion is in contact with prongs of u-clamped bar 33. This relationship permits movement of the track and having a defined path. When the clip 36 is released and allowed to slip back into one of the notches 34, or the bolts 38, 39 are securely tightened, then the reflector 20 is fixed relative to the socket 14, base 32, and light source 12.

In an alternate embodiment, as ghosted in FIGS. 3 and 4, a guiding groove 40 is provided in which a guide pin 42 that is attached to the base 32 translates. The guide pin 42 and groove 40 aid in smooth transitions of the reflector 20 from one orientation to another about the light source, as well as lessening the possibility of rotation of the reflective surface 20 relative to the base 16 and socket 14.

The track 30 of the preferred embodiment preferably defines a portion of a circle, the light source 12 being at its center. The preferred embodiment of the track 30 allows the reflector 20 to be adjusted without substantially affecting the optics associated therewith.

With reference to FIG. 3, control and power cables 43 extend from the bottom of the socket 14 through the channel 22. In this embodiment channel 22 therefore also functions as a wire entry port, through which the power cables 43 which supply electric power to the light source or lamp 12 pass. A flange 45 is included so that the device 10 may be secured into a protective housing (not shown). The flange 45 includes screw holes 47 or other means of securement so that the flange 45 may be fixedly attached to the protective housing, and remain stationary with reference thereto. The light source remains substantially vertical with reference to the ground as described previously. Thus, the reflector 20 and protective housing are preferably tilted together, while the light source 12 remains stationary. The protective housing of the preferred embodiment protects the assembly 10 from the elements and other hazards in outdoor applications.

The disclosed embodiments may also include a retractable shield 44. The shield 44 is preferably constructed of the same material as the reflector 20 and is adjacent to the socket 14 covering the channel 22 as the housing is moved. Preferably, the shield 44 includes multiple sections that resemble overlapping scales, the scales retracting underneath each other when the reflector 20 is moved in one direction, and extending out from underneath each other when the reflector 20 is moved in the other direction.

It is to be understood that both of the above-disclosed preferred embodiments include sockets 14 that are fixedly attached to stationary bases. This allows the preferred reflectors 20 to pivot about the light sources 12 while the light sources 12 remain stationary.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A directional illuminating device comprising:

a base;

a socket for receiving a light source, the socket being secured to the base;

a reflector movably connected to the base for re-directing and focusing light emanating from the light source, the focusing and re-directing being dependent upon movement of the reflector; and, a channel formed in the reflector that includes intervals, the intervals being all approximately equidistant from a center of the light source through which channel the socket is fixedly connected to the base.

2. A directional illuminating device comprising:

a base;

a socket for receiving a light source, the socket being secured to the base;

a reflector movably connected to the base for re-directing and focusing light emanating from the light source, the focusing and re-directing being dependent upon movement of the reflector;

a channel formed in the reflector through which the socket is fixedly connected to the base; and, a slidable shield that covers the channel as the reflector translates about the light source.

3. A directional illuminating device comprising:

a socket for receiving a light source;

a U-shaped cradle to which the socket is mounted;

a base formed to include the U-shaped cradle;

a reflector movably connected to the base for re-directing and focusing light emanating from the light source, the focusing and re-directing being dependent upon tilting the reflector with respect to a vertical axis;

a plurality of hinging pivots in association with the bare which support the reflector; and a channel formed in the reflector through which the socket is fixedly connected to the base.

4. The directional illuminating device as set forth in claim 3, wherein the U-shaped cradle includes:

at least one wire entry port to allow power supply wires to reach the light source.

5. The directional illuminating device as set forth in claim 3, wherein the hinging pivots include securements that lock the position of the reflector.

6. The directional illuminating device as set forth in claim 3, wherein the channel allows the reflector 45° of rotation about the light source.

7. The directional illuminating device as set forth in claim 3, wherein the light source in a substantially vertical position.

8. The directional illuminating device as set forth in claim 3, wherein the light source is a pulse-arc metal halide lamp.

9. A directional illuminating device comprising:

a base;

a socket for receiving a light source, the socket being secured to the base;

a reflector movably connected to the base for re-directing and focusing light emanating from the light source, the focusing and re-directing being dependent upon tilting the reflector with respect to a vertical axis;

a channel formed in the reflector through which the socket is fixedly connected to the base; and a guide track formed in th reflector through which a portion of the socket extends, wherein the guide track includes discrete settings at which the socket may be secured to the base portion.

10. A directional illuminating device comprising:

a socket for receiving a light source;

a base assembly that is fixedly connected to the socket, holding the light source in a substantially vertical position;

a reflector movably connected to the socket for re-directing and focusing light emanating from the light source, the focusing and re-directing being dependent upon tilting the reflector relative to the light source;

a guide track formed in the reflector through which the socket is fixedly connected to the base assembly, the guide track providing a range of arc for the reflector about the light source.

11. A directional illuminating device comprising:

a socket for receiving a light source;

a reflector movably connected to the socket for re-directing and focusing light emanating from the light source, the focusing and re-directing being dependent upon movement of the reflector;

a base assembly including at least one fastener for fixing the reflector relative to the light source, the base assembly being fixedly connected to the socket, holding the light source in a substantially vertical position;

a guide track formed in the reflector through which the socket is fixedly connected to the base assembly, the guide track providing a range of arc for the reflector about the light source.

12. The directional illuminating device as set forth in claim 10, wherein the light source is a pulse arc metal halide lamp.

13. A directional illuminating device comprising: a socket for receiving a light source;

a reflector movably connected to the socket for re-directing and focusing light emanating from the light source, the focusing and re-directing being dependent upon movement of the reflector;

a base assembly that is fixedly connected to the socket, holding the light source in a substantially vertical position;

a guide track formed in the reflector through which the socket is fixedly connected to the base assembly, the guide track providing a range of arc for the reflector about the light source; and, a shield for covering a socket-accommodating channel in the reflector as the reflector moves relative to the socket.

14. A directional illuminating device comprising:

a socket for receiving a light source;

a base to which the socket is fixedly mounted, the base formed to include a U-shaped member;

a reflector movably connected to the base for re-directing and focusing light emanating from the light source, the focusing and re-directing being dependent upon tilting the reflector;

a channel formed in the reflector, the channel providing freedom of motion for the reflector about the light source;

securements for rotatably attaching the reflector to the base, the securements also being capable of fixedly attaching the reflector to the base, wherein the securements engage the reflector at a height approximately equal to a height of a center of the light source from tips of the U-shaped member.

15. A directional illuminating device comprising:

a socket for receiving a light source;

a base to which the socket is fixedly mounted;

a reflector movably connected to the base for re-directing and focusing light emanating from the light source, the focusing and re-directing being dependent upon movement of the reflector;

a channel formed in the reflector, the channel providing freedom of motion for the reflector about the light source;

a slidable shield for covering the channel as it translates about the socket; and, securements for rotatably attaching the reflector to the base, the securements also being capable of fixedly attaching the reflector to the base.

* * * * *